United States Patent [19]

Ohtsuki et al.

[11] 4,168,879

[45] Sep. 25, 1979

[54] CONTACT ELEMENT OF AN ELECTRIC CONNECTOR

[75] Inventors: Tomonari Ohtsuki, Tokyo; Yoshiaki Igarashi, Ichikawa; Yasuharu Sawahata; Toshio Kobayashi, both of Mooka; Hiromasa Inoue, Musashino, all of Japan

[73] Assignee: Daiichi Denshi Kogyo Kabushiki Kaisha, Tokyo, Japan

[21] Appl. No.: 871,882

[22] Filed: Jan. 24, 1978

[30] Foreign Application Priority Data

Jan. 24, 1977 [JP] Japan ..... 52-6274[U]

[51] Int. Cl.[2] ..... H01R 11/22

[52] U.S. Cl. ..... 339/258 P; 339/176 MF; 339/176 MP

[58] Field of Search ..... 339/176 MF, 176 MP, 339/258 R, 258 P

[56] References Cited

U.S. PATENT DOCUMENTS 3,495,132 2/1970 Anhalt et al. ..... 339/176 MP

FOREIGN PATENT DOCUMENTS 1640384 9/1970 Fed. Rep. of Germany ... 339/176 MP

*Primary Examiner*—Gerald A. Dost

*Attorney, Agent, or Firm*—Sughrue, Rothwell, Mion, Zinn and Macpeak

[57] ABSTRACT

A contact element of an electric connector to be mated with a flat flexible film circuit board. The contact element affords a good electrical connection and also easy disengagement of the circuit board by providing a semi-conical projection on the end of its spring portion and by providing a slant surface from the conical projection to an end of the spring portion.

4 Claims, 15 Drawing Figures

CONTACT ELEMENT OF AN ELECTRIC CONNECTOR

BACKGROUND OF THE INVENTION (1) Field of the Invention

The present invention relates to a contact of an electric connector, more especially to a contact of a connector suitable for connecting a flat flexible film printed circuit board.

(2) Description of the Prior Art

In the recent development of the miniaturization of the electronics parts, the flexible wiring system using a flat flexible film printed circuit board has become more and more popularly used for interconnecting the devices in electronic equipment.

In such a flexible wiring system, it is popular to arrange at least one end of such a flat flexible film printed circuit board to act as a male contact member. The male contact member formed at one or both ends of the flat flexible film printed circuit board generally comprises a number of male contact elements provided by a printed wiring technique such as applying copper foil or applying etching if required. The male contact elements are arranged in parallel rows spaced equidistantly. The male contact member is inserted into a female contact member provided on the equipment side. The female contact member is generally formed as a multi-contact member having a number of female contact elements. The female contact elements are connected by wiring to desired electronic devices.

The flat flexible film printed circuit board is very thin and hence it has less stiffness. Accordingly, for a large numbered multi-contact member, such as for example of 20 or more terminals, difficulty arises when inserting the male contact member formed by the flexible film circuit board into a female connector member.

It is known to provide a lining at the terminal portion of the flexible film printed circuit board using, for instance, a polyester plate to make the thickness of the contact portion thereof larger to attain an easy insertion.

This practice has, however, a disadvantage in that a large force is required when disengaging the connection when the connection needs to be disconnected, for instance, at some maintenance purpose. The increase of pulling force at disengagement of the connector is very high and is much higher than ordinarily expected due to increase of the contact pressure. The increase of pulling off force of the connector member may reach 3 to 4 times the former value when such lining is not used. By reason of such high pulling off force when the connector member is desired to be disengaged not only uneasiness of handling results, but in some occasion the flat flexible film printed circuit board may be torn or damaged.

SUMMARY OF THE INVENTION

The present invention is to improve abovementioned disadvantages of a conventional connector element to be connected with such a flat flexible film printed circuit board.

The present invention has been obtained by a realization of the cause of such disadvantages of the conventional connectors through a very careful analysis. It has been found that such high pulling off force at disengagement is resulted mainly from the nature of binders used for fixing and lining the flat flexible film and from the shape of contacting portion of the female contact element used in the female contact member. Namely, the present invention is to improve disadvantage of increase of pulling off force of such a connector by rearranging the shape of the female contact element.

In the manufacture of a flat flexible film printed circuit board, a lining polyester film is adhered at back side of such film circuit board after the manufacture of the printed circuit board by using an adhesive previously applied on the polyester film. For such adhesive a soft adhesion binder which may keep softness during the life without becoming hard is used. The thickness of such adhesive may be about 100 μm for applying 300 μm lining plate. The thickness of the circuit board used in the above embodiment is about 80 μm of which detail is as follows.

copper foil: 35 μm
binder: 20 μm
base insulation material: 25 μm

The present invention has been obtained by assertioning the abovementioned cause and it realized a contact element of such kind of electric connector, which may be disengaged between the flat flexible film printed cirucit board and the female connector contact by a relatively small pulling off force and neverthless it establishes a very good contact condition therebetween.

DESCRIPTION OF THE PREFERRED EMBODIMENTS

The invention will now be described in more detail by referring to the accompanied drawings.

In order to help better understanding of the invention, at first shape and behavior of a conventional female contact element will be explained by referring to FIGS. 1*a* to 1*d*.

Figure 1A:
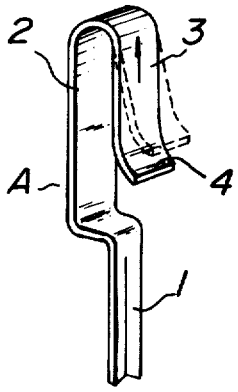
FIG. 1a PRIOR ART
FIG. 1*a* shows in perspective view of a female contact element of a conventional multi-contact connector for connecting the flat flexible film printed circuit board.

FIG. 1*a* shows in perspective view a conventional type female contact element generally designated by A to be used in a multi-contact connector for the flexible film printed circuit board. This contact element A has a terminal portion 1 extended from L shaped body portion 2 and a spring portion 3 bent at the top of the body portion 2. End of the spring portion 3 is formed to be an acute angle edge 4.

Figure 1B:
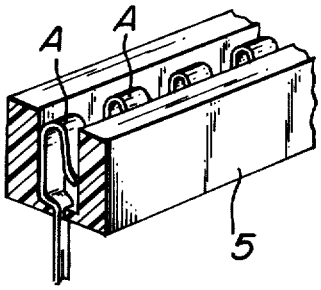
FIG. 1b PRIOR ART
FIG. 1*b* shows a perspective view partly in cross-section of a female contact member accommodating a number of the conventional female contact elements shown in FIG. 1*a*.

A desired number of such female contact elements A are mounted in an insulator base 5 as shown in FIG. 1*b*. It should be noted that FIG. 1*b* shows only general shape of a connector member and the detailed shape not related to the present invention is not illustrated.

The female contact element A, when inserted in the respective location in the insulator base 5, is clamped in position by means not shown in detail and its acute angle edge 4 is urged against one wall of the insulator base 5. In FIG. 1*a*, solid line for the spring portion 3 means such biased position and dotted line shows unrestricted condition thereof. A flat flexible film printed circuit board 6 such as for example shown in FIG. 5 may be inserted between the acute angle edge 4 of the spring portion 3 and a wall of the insulator base 5 against which the edge is urged. On one side of the printed circuit board 6, there is provided with a corresponding number of male contact terminals **7*d* made for example by copper foils adhered on the board. The circuit board 6 is inserted into the female contact member in a manner that the male contact terminal formed by the copper foil 7*d*** is facing against the female contact element A.

Figure 1C:
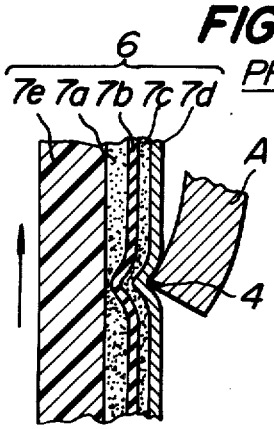
FIG. 1c PRIOR ART
FIG. 1*c* shows a cross-sectional side view in partly enlarged scale for explaining engagement of a conventional contact element and the film printed circuit board.
Figure 1D:
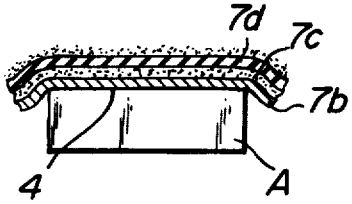
FIG. 1d PRIOR ART
FIG. 1*d* shows a cross-sectional top view of FIG. 1*c*.

As mentioned above such a circuit board may be lined with a plastic plate for obtaining more stiffness. FIG. 1*c* or 1*d* shows in greatly exaggerated scale for the circuit board portion and lining illustrated by reference numeral 6. This figure shows a condition of engagement between the acute angle edge 4 of the spring portion 3 and the circuit board mounted on a lining.

The circuit board comprises at the surface side a copper foil **7*d* fixed to an insulator film 7*b* by an adhesive layer 7*c*. The insulation film 7*b* of the circuit board is supported by a lining film 7*e* such as a polyester film fixed by a soft adhesive layer 7*a***.

As mentioned above, the thickness of the respective portion is as follows in one example.

| | | |
|---|---|---|
| copper foil 7d : | 35 μm | circuit board 80 μm |
| adhesive layer 7c : | 20 μm | |
| base insulation film 7b : | 25 μm | |
| soft adhesive layer 7a : | 100 μm | |
| lining polyester film 7e : | 300 μm | |

As the soft adhesive layer **7*a* has a considerable thickness, it deforms by the contact pressure of the acute angle edge 4 of the spring portion 3** as shown in FIG. 1*c* or 1*d* and the edge 4 cuts into the circuit board with lining 6. This provides a good electric connection between the two elements. However, when the connection should be disengaged and the circuit board with lining 6 is pulled upwards relatively as shown by arrow, the acute angle edge 4 of the spring portion 3 may create a large resistive force against such upward pulling force for disengagement. This will result in certain cases breakage of the film circuit board forming the male contact and the film circuit board may not be used again. Since the flat flexible film printed circuit board is designed to repeated use of such connection and disconnection, the above-mentioned large resistive force at the disengagement may result a great disadvantage in the conventional connector.

The present invention is to improve above-mentioned disadvantages.

Figure 2A:
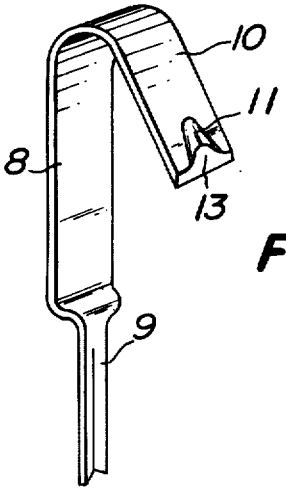
FIG. 2*a* shows in perspective view of a female contact element made in accordance with the present invention, and this element can be used in place of that shown in FIG. 1*a* and the drawing shows non-restricted condition of the contact element.

FIG. 2*a* shows a female contact element made in accordance with the present invention. The contact element comprises body portion 8, terminal portion 9, and spring portion 10 formed by bending at the top of the body portion 8. At free end of the spring portion 10, a projection 11 which forms an essential portion of the present invention is provided. This projection 11 has semi-cone shape as better can be seen from FIG. 2*b*. The semi-cone shaped projection 11 is defined by a slant surface 13, which also forms an essential feature of the present invention, and forms a round or parabolic edge line **11*a*. The bottom surface of the projection 11 against the surface of the spring portion 10 becomes triangle shape located at middle of the portion and having the bottom edge located at the upper edge of the free end thereof. The height of the projection 11 is so selected as the both shoulder portions 10*a* of the spring portion 10 do not contact with the surface 12*a* of the flat flexible film printed circuit board 12 even when the top of the projection 11** sinks into the printed circuit board as shown in FIG. 3*a* diagrammatically.

Figure 2C:
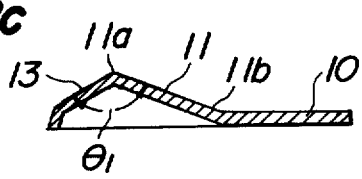
FIG. 2*c* is a cross-section of the same taken along line C—C.
Figure 3A:
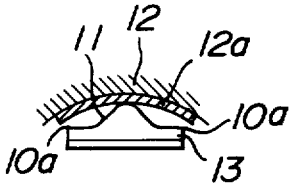
FIGS. 3*a* and 3*b* are diagrammatic views for explaining function of the contact element of the present invention.
Figure 3B:
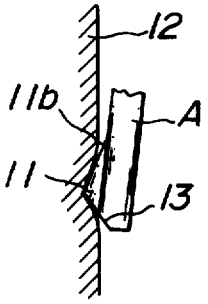

The slant surface 13 forms a slipping surface of the female contact element against the film circuit board. This surface 13 extends from the top of the cone shaped projection 11 to an end surface **10*b* and defining an edge below the level of the shoulder portion 10*a*. The inclination of the slant surface 13 is so selected as to make the opening angle $\theta_1$ between a top edge 11*b* of the semi-cone shaped triangle projection 11** becomes an obtuse angle as shown in FIG. 2*c*. The length of the slant surface 13 is so selected that a part of the slant surface 13 located at the edge surface **10*b* of the spring portion 10 appears out of the printed circuit board even when the top of projection 11*a* of the contact sinks into the flat flexible film printed circuit board 12** as shown in FIG. 3*b*.

The female contact element may be manufactured for instance by pressing or the like. This female contact element may be inserted into a fixing hole of an insulating base. A number of the elements are usually inserted into such holes and a multi-contact female connector assembly is formed. Fixing of each of the female contact againt such insulator hole is obtained either by providing a shoulder portion at upper portion of the contact body 8 or fixing pin at center of the body 8. The shoulder portion is indicated in FIG. 2*a*. As this is a conventional means, the indication is just diagrammatically. But it should be noted that the spring portion 10 is also narrowed for the lateral width accordingly. The fixing pin or projection is not shown in the drawing as these are known per se.

According to the present invention, two advantages may be obtained.

The first advantage is that by the provision of the semi-conical projection 11 provides a higher contact pressure by one point contact between the top edge **11*a* and the male terminal conductor of the film circuit board. The top edge 11*a* adjoined with the slant surface 13** contacts against the male conductor with much higher contact pressure per unit surface area if compared with the conventional female contact element having an acute angle straight contact edge as shown in FIG. 1*a*.

The second advantage is that by the provision of slant surface 13 forming slipping surface adjoining the top edge 11*a* and forming an obtuse angle $\theta_1$ with a top edge 11*b* so that the resistive force at the time of pulling off the film circuit board is much smaller than the conventional female contact having acute angle edge portion. Thus the pulling off force may be greatly decreased.

In the foregoing the invention has been described with respect to a basic embodiment.

There may be a case where the whole surface of the slant surface 13 forming an escape surface sinks into the flat flexible film printed circuit board due to the thickness or viscocity of the soft adhesive layer for fixing the lining polyester plate or irregularity of the film circuit board.

If the end surface 10*b* of the spring portion 10 is cut normal to the surface, an edge 10*c* formed between the end surface 10*b* and the slant surface 13 may engage the terminal surface of the circuit board and results an increase of pulling off force.

Figure 4A:
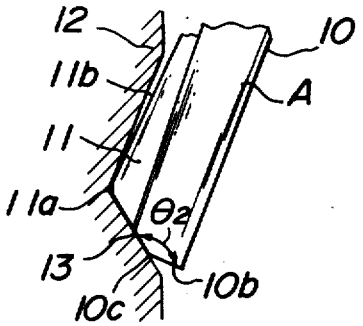
FIGS. 4*a*, 4*b* and 4*c* are corresponding explanatory views of an alternative embodiment of a contact of the present invention.

In order to prevent such inconvenience, an angle $\theta_2$ formed between the slant surface 13 and the end surface 10*b* is made a large obtuse angle as shown in FIG. 4*a*. Further the inclination of the top edge or generating line 11*b* of the semi-conical projection 11 should be so selected that always a point contact between the top edge 11*a* and the film circuit board 12 is maintained as shown in FIG. 4*a*. By the selection of inclination of the line 11*b* the point contact 11*a* slips over the terminal piece of the circuit board 12 and always a good electric connection is obtained.

Figure 4B:
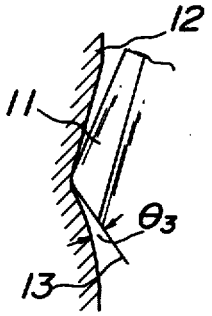

In the foregoing, the explanation had been made to make the angle $\theta_1$ between the slant surface 13 and the top edge 11*b* of the semi-conical projection 11 to be an obtuse angle. However, a more good result may be obtained by selecting said angle $\theta_1$ by carefully considering the condition of the circuit board and to leave an acute angle $\theta_3$ between the slant surface 13 and the top surface or terminal surface of the circuit board 12 as shown in FIG. 4*b*. By such arrangement, the slant surface 13 or slipping surface may move off the circuit board 12 very smoothly.

Figure 2B:
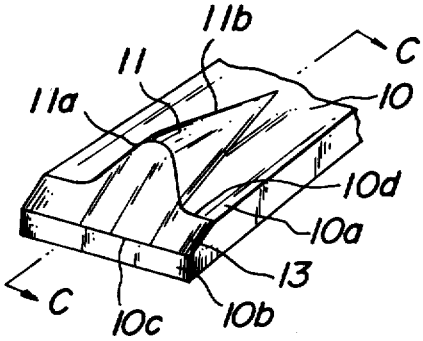
FIG. 2*b* is an enlarged perspective view of the contact edge portion of the contact element shown in FIG. 2*a*.
Figure 4C:
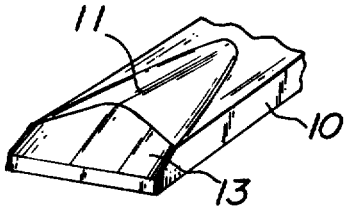

In the foregoing example, the shape of end of the contact is made to leave shoulder edge portion 10*d* as shown in FIG. 2*b*. However, it is possible to make the shape without leaving such shoulder edge portion 10*d*. This is illustrated in FIG. 4*c*.

In the conventional female contact element, the spring portion 3 shown in FIG. 1*a* is bent from the top of the body portion 2 and shaped to gradually apart therefrom as depicted in the drawing so as to obtain a good contact by the edge 4 and also to prevent cut in of the contact edge 4 in the film circuit board when the circuit board is pulled off by causing an upward force as indicated in the drawing by arrow mark to prevent lifting up of the spring toward the non-restricted position shown by dotted line. However, in accordance with the present invention such consideration is not required because the increase of pulling out force is prevented by the shape of the contact projection and the slipping surface. As the result the shape of spring portion 10, the contact element can be made more simple as shown in FIG. 2*a*, which shows a straight shape. This contributes for the easiness of manufacture.

Figure 5:
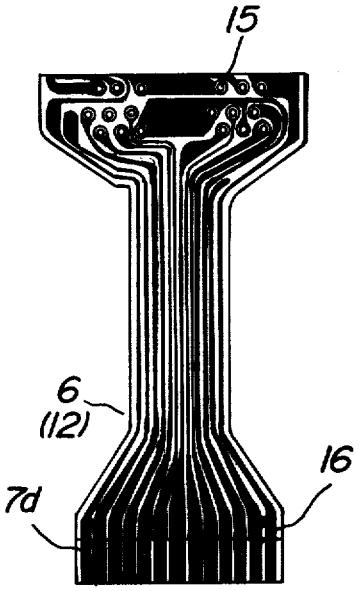
FIG. 5 shows one embodiment of a flat flexible film printed circuit board.

FIG. 5 shows one example of flat flexible film printed circuit board 6(12) for easy understanding of the present invention. The circuit board contains printed wiring according to respective design. Each wiring extends from wiring terminal 15 to a male contact 7*d* where copper foil or wiring is exposed for electric connection. Portions other than the terminal and the contact are covered by insulating film. Numeral 16 shows just a mounting base for other necessary electronics part for instance diodes or the like.

Figure 6:
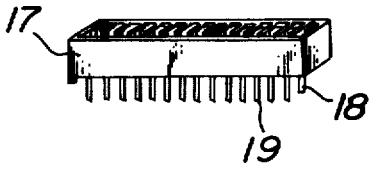
FIG. 6 shows one embodiment of a multi-contact female connector member.
Figure 7:
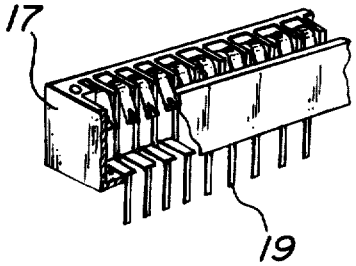
FIG. 7 is a perspective of the same.

This circuit board is inserted into a multi-contact female connector member 17 shown in FIG. 6. The multi-contact female connector 17 comprises terminals 19 and a registration plug 18. FIG. 7 shows also the connector member seen from other side and slightly enlarged scale.

The contact element according to the present invention may also be used in an ordinary female connector member to which ordinary male connector is inserted.

As can be understood clearly, according to the present invention, an electric contact element providing a good electric connection and also having feature of easy pulling off of the film printed circuit board can be obtained. The invention affords considerable advantages in practice.

It is not so strict, however, in practice it has been found convenient to make the angle $\theta_1$ about 140° and $\theta_2$ about 135°. Tolerance for both angles may be ±15°.

What is claimed is:

1. A female contact element of a multi-contact female electrical connector adapted to matingly receive a corresponding multi-contact male connector configured as a flat, flexible film printed circuit board, comprising:

(a) a unitary body member having a connecting terminal on one end and a spring portion on the other end formed by bending the body member into an uneven legged U configuration, with the spring portion comprising the shorter leg of the U;

(b) an electrical contact portion defined on the end of the spring portion and including a semi-conical projection having its bottom oriented toward and contiguous with the end of the spring portion, the lateral height of the base of the semi-conical projection above the surface of the spring portion being sufficient to prevent any shoulder areas on the spring portion flanking the base of the conical projection from engaging the surface of an inserted male connector; and (c) the end of the spring portion having a chamfered slant surface extending from the bottom edge of the spring portion into and through the base of the semi-conical projection and forming an obtuse angle with a plane tangent to the outermost side surface of said projection.

2. A contact element as claimed in claim 1, wherein said obtuse angle is so selected that an angle of clearance defined between the slant surface and the surface of the male connector is larger than 0° and smaller than 90°.

3. A contact element as claimed in claim 1, wherein said obtuse angle is 140°±15°.

4. A contact element as claimed in claim 3, wherein a further obtuse angle of 135°±15° is defined between the slant surface and the bottom edge of the spring portion.

* * * * *